United States Patent [19]

Swartz

[11] Patent Number: 4,800,108

[45] Date of Patent: Jan. 24, 1989

[54] COMBINATION NAPKIN AND TABLE SETTING HOLDER

[76] Inventor: Ralph E. Swartz, 880 98th Ave. N., Naples, Fla. 33963

[21] Appl. No.: 172,435

[22] Filed: Mar. 24, 1988

[51] Int. Cl.[4] ..... B32B 3/08

[52] U.S. Cl. ..... 428/43; 428/78; 150/52 C

[58] Field of Search ..... 428/43, 78; 150/52 C; 206/553; 30/137; D6/595

[56] References Cited

U.S. PATENT DOCUMENTS

| | | | |
|---|---|---|---|
| 1,650,393 | 11/1927 | Schaefer | 150/52 C |
| 3,978,553 | 9/1976 | Honig | 428/40 |
| 4,177,846 | 12/1979 | Rountree | 150/52 C |

*Primary Examiner*—Alexander S. Thomas

*Attorney, Agent, or Firm*—Merrill N. Johnson

[57] ABSTRACT

A combination napkin and table setting holder made entirely of paper. The device consists of a single sheet of absorbent paper in rectangular form approximately twelve inches by sixteen inches wide which contains a single straight line of perforations which divides the sheet into a twelve inch by twelve inch square napkin and a rectangle approximately twelve inches by four inches wide to which is attached a second sheet of paper having the same width as the width of the aforesaid rectangle and a height of approximately eight inches having its two opposite sides and lower edge bonded to the lower edge and two sides of the aforesaid rectangle to form an open topped pocket designed to receive a knife, fork and spoon or similar utensils making up an individual table setting.

2 Claims, 1 Drawing Sheet

COMBINATION NAPKIN AND TABLE SETTING HOLDER

BACKGROUND AND SUMMARY OF THE INVENTION

My invention lies in the field of paper napkins and particular provides a combination paper napkin and a holder for an individual place setting of eating utensils.

In most restaurants utilizing bare table tops, after the customers served at a particular table depart the bus boy or waitress clears off the dishes and wipes the bare table top with a damp rag and then sets the table with a place setting of eating utensils and a folded paper napkin for each member of the next group of customers to occupy that table.

Such practice, though widespread, is unsanitary and resented by many people who dislike having to use eating utensils laid directly onto a moist table top which may contain disease carrying contaminants.

The most important object of my invention is to provide sanitary protection of the flatware placed on the tops of tables and counters in restaurants and other establishments serving food to the public.

A further object of my invention is to provide in one package both the paper napkin regularly placed at each table setting and also a protective sheath for holding a single place setting of flatware, usually a knife, a fork and a spoon.

Another object of my invention is to provide a combination napkin and table setting holder made entirely of paper.

Simply stated, my combination napkin and table setting holder consists of a first sheet of absorbent paper in rectangular form approximately twelve inches high by sixteen inches wide. The absorbent sheet contains a single straight line of perforations which divides the sheet into a twelve inch by twelve inch square napkin and a rectangle approximately twelve inches high and four inches wide to which is attached a second sheet of paper having the same width as the rectangle and a height of approximately eight inches with its two opposite sides and its lower edge bonded to the two sides and lower edge of the rectangle to form an open topped pocket designed to receive the knife, fork and spoon or similar utensils forming an individual table setting.

As described, my invention provides an economical means of improving the sanitary conditions in restaurants and other institutions serving food to individuals. The pocket for the table setting and/or the napkin itself can be printed with various advertising matter or decorative designs to enhance the appearance of the device.

BRIEF DESCRIPTION OF THE DRAWINGS

The objects of my invention will be readily understood by reference to the accompanying drawings in which.

DETAILED DESCRIPTION OF THE PREFERRED EMBODIMENT

Figure 1:
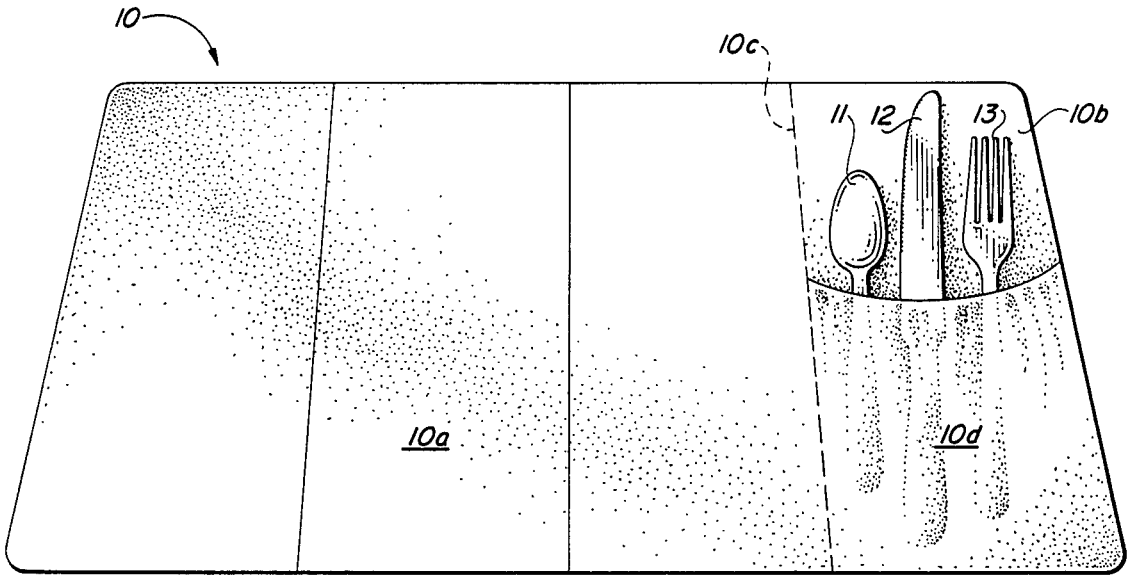
FIG. 1 is a perspective view of a preferred embodiment of my combination napkin and table setting holder showing a place setting consisting of a spoon, knife and fork in the pocket of the table setting holder.
Figure 2:
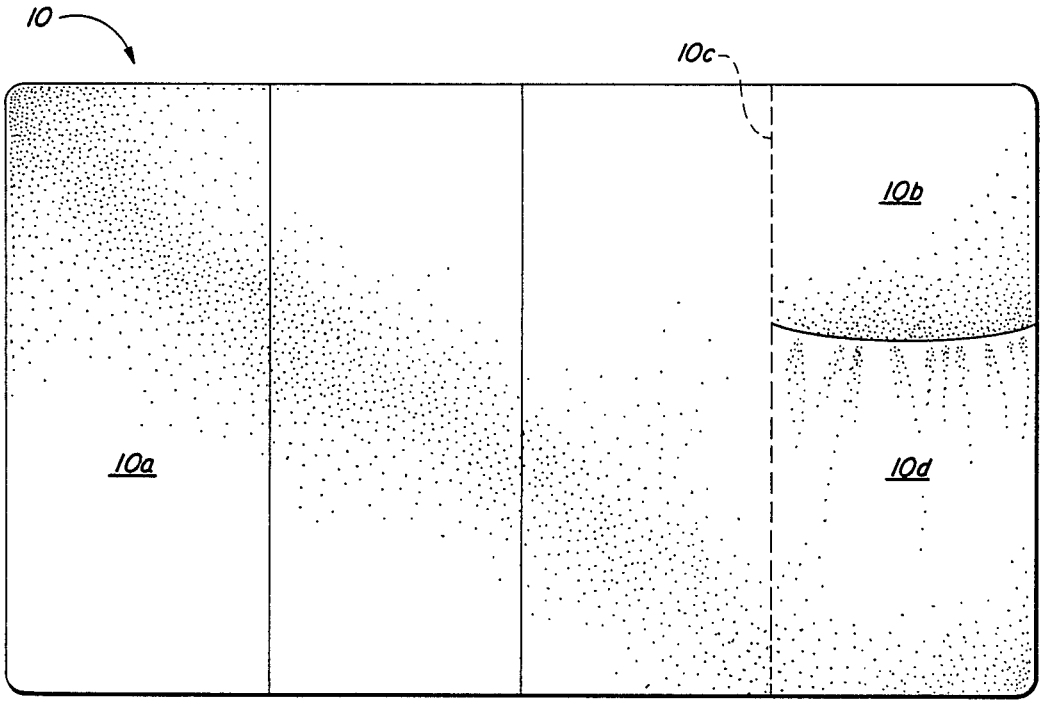
FIG. 2 is a top plan view of the combination napkin and table setting holder shown in FIG. 1.

Referring to the drawings, FIGS. 1 and 2 illustrate a preferred form of my combination napkin and table setting holder 10 which includes napkin 10*a* and table setting holder 10*b* divided by a straight line of perforations 10*c*. Napkin 10*a* and holder 10*b* comprise a single sheet of absorbent paper preferably the type of paper used to make high quality paper napkins.

Napkin 10*a* is preferably about twelve inches square and table setting holder 10*b* preferably about twelve inches high and four inches wide. Attached to holder 10*b* is a second sheet of paper 10*d* which may or may not be absorbent measuring about eight inches high and four inches wide. The two opposite sides of paper 10*d* and its lower edge are permanently bonded by a glue or similar means to the lower edge of holder 10*b* and its vertical edges to form an open-topped pocket between holder 10*b* and sheet 10*d*. This pocket is sized to handily receive a single place setting of eating utensils such as spoon 11, knife 12, and fork 13 shown in FIG. 1.

In packaging my combination napkin and table setting holder, the entire device 10 is preferably folded along the line of perforations 10*c* and also along the two parallel unnumbered lines appearing on napkin 10*a* in both FIGS. 1 and 2. Thus folded, combination napkin and table setting holder 10 can be easily packaged, shipped and stored in bundles of fifty or more pieces in a similar manner to ordinary paper napkins.

Use of my invention will promote more sanitary conditions in restaurants and other institutions serving food to the public. Its use will also create good will for the owner of the restaurant, especially among the considerable segment of the public who dislike having to use eating utensils which lie directly on a table or counter top which has been wiped with a damp cloth in an effort to "clean" the table top.

While I have shown and described a preferred embodiment of my combination napkin and table setting holder, it should be understood that such description will suggest certain changes in dimensions and form to those skilled in the art and that the true scope of my invention is set forth only in the appended claims.

I claim:

1. A combination napkin and table setting holder made of paper comprising a first sheet of absorbent paper in rectangular form having a single line of perforations running from the top edge to the bottom edge of the sheet parallel to the sides of the sheet which divides the sheet into a square paper napkin and a rectangular table setting holder, and a second sheet of paper in rectangular form having the same width as the table setting holder of the first sheet and a height approximately two thirds that of the holder, the two opposite sides and the lower edge of the second sheet of paper being bonded to the lower edge and opposite sides of the table setting holder of the first sheet to form an open-topped pocket between said sheets designed to receive an individual setting of eating utensils.

2. A combination napkin and table setting holder made entirely of paper comprising a first sheet of highly absorbent paper in the form of a rectangle approximately twelve inches high and sixteen inches wide having a single straight line of perforations running from the top edge to the bottom edge of the sheet which divides the sheet into a twelve inch square paper napkin and a rectangular table setting holder approximately twelve inches high and four inches wide, and a second sheet of paper in the form of a rectangle approximately eight inches high and four inches wide, the lower edge and two opposite sides of the second sheet being bonded to the lower edge and opposite sides of the table setting holder of the first sheet to form an open-topped pocket between said sheets designed to receive an individual setting of eating utensils.

* * * * *